US007866068B2

(12) United States Patent
Van Buren et al.

(10) Patent No.: US 7,866,068 B2
(45) Date of Patent: Jan. 11, 2011

(54) SNOWBLOWER DRIVE ASSIST SYSTEMS AND METHODS

(75) Inventors: Jason R. Van Buren, Mebane, NC (US); Jorgen K. Meister, Mebane, NC (US); Kevin D. King, Chapel Hill, NC (US)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 12/437,214

(22) Filed: May 7, 2009

(65) Prior Publication Data

US 2010/0281718 A1 Nov. 11, 2010

(51) Int. Cl.
*E01H 5/04* (2006.01)

(52) U.S. Cl. ..... 37/244

(58) Field of Classification Search ..... 37/197, 37/232, 233, 243–251, 466, 468, 260; 180/9.21, 180/9.26, 9.28, 9.3; 172/114
See application file for complete search history.

(56) References Cited

U.S. PATENT DOCUMENTS 3,269,100 A 8/1966 Smith
3,423,856 A * 1/1969 Fiske ..... 37/244
4,064,679 A * 12/1977 Spinner ..... 56/2
4,756,101 A 7/1988 Friberg et al.
5,119,880 A 6/1992 Zehrung, Jr. et al.
5,438,770 A * 8/1995 Miller ..... 37/227
6,470,602 B2 10/2002 White, III et al.
7,159,343 B2 1/2007 Hanafusa et al.
2007/0084091 A1 4/2007 Umemura

* cited by examiner

*Primary Examiner*—Robert E Pezzuto
(74) *Attorney, Agent, or Firm*—Jenkins, Wilson, Taylor & Hunt, P.A

(57) ABSTRACT

A snowblower can include a snowblower housing, an auger connected to the housing, at least one wheel attached to the housing, and a machine control component. The machine control component can be movable to selectively control the movement of the wheels relative to the housing between a first position and a second position. In particular, the machine control component can be movable to a disengaged position, in which the at least one wheel is positioned in the first position and the auger is raised above a ground surface. The machine control component can further be moved to an engaged position, in which the at least one wheel is positioned in the second position and the auger is operatively engaged with the ground surface.

19 Claims, 7 Drawing Sheets

SNOWBLOWER DRIVE ASSIST SYSTEMS AND METHODS

TECHNICAL FIELD

The subject matter disclosed herein relates generally to snowblowers. More particularly, the subject matter disclosed herein relates to snowblowers having an auger movable between an engaged position and a disengaged position.

BACKGROUND

Most common designs for snowblowers include a housing supported by one or more wheels and with a handle assembly extending upwardly and rearwardly from the housing so that the operator can hold the handle assembly and walk behind the snowblower as it moves over the ground. At the front of the housing, a snow-throwing impeller or paddle is used for engaging and throwing snow. In such a configuration, as the snowblower is moved forward, snow that is brought into contact with the impeller is thrown to a desired area away from the path to be cleared. This general arrangement, however, will not always operate efficiently in all conditions. In particular, in situations involving wet, heavy, or hard packed snow, the front of the snowblower can tend to ride on top of the snow rather than pressing into the snow. To compensate for such issues, the operator generally has to push the handle assembly forward or upward—often applying a fairly continuous upward pressure—to keep an adequate amount of downward pressure on the front of the snowblower so as to keep the auger in contact with the snow. Lifting the snowblower in this way, however, can be difficult and tiring to do. Further, such lifting takes weight off the wheels, making the machine less stable and thus requiring extra work for the user.

SUMMARY

In accordance with this disclosure, systems and methods for operating a snowblower are provided. In one aspect, a snowblower is provided and can include a snowblower housing, an auger connected to the housing, at least one wheel attached to the housing, and a machine control component. The at least one wheel can be movable relative to the housing between a first position and a second position to raise at least a portion of the housing, the wheel in the first position being in a proximate position to the housing, and the wheel in the second position being in an extended position further away from the housing. The machine control component can be movable to selectively control the movement of the at least one wheel relative to the housing. Specifically, the machine control component being can be movable between a disengaged position, in which the at least one wheel is positioned in the first position, and an engaged position, in which the at least one wheel is positioned in the second position.

In another aspect, a snowblower is also provided, and the snowblower can include a snowblower housing, an auger connected to the housing, a handle assembly connected to the housing and including a machine control component, a lever arm pivotably attached to the housing and operably connected to the machine control component, and at least two wheels attached to a rear portion of the housing and supporting the housing, at least one of the wheels being connected to the lever arm. The wheels can be movable with the lever arm relative to the housing between a first position and a second position, where in the first position the wheels are close to the housing, and in the second position the wheels are extended away from the housing. The machine control component can be movable to selectively control the movement of the wheels relative to the housing, the machine control component being movable between a disengaged position, in which the wheels are positioned in the first position, and an engaged position, in which the wheels are positioned in the second position.

In yet another aspect, a method for operating a snowblower is provided. The method can include providing a snowblower having a snowblower housing, with an auger, at least one wheel, and a handle assembly connected to the housing. The method can further include moving a machine control component between a disengaged position and an engaged position. Specifically, moving the machine control component can move the at least one wheel relative to the housing such that when the machine control component is in a disengaged position, the wheel is in a first position proximate to the housing, and when the machine control component is in an engaged position, the wheel is in a second position further away from the housing.

Some of the aspects of the subject matter disclosed herein having been stated hereinabove, and which are addressed in whole or in part by the presently disclosed subject matter, other aspects will become evident as the description proceeds when taken in connection with the accompanying drawings as best described hereinbelow.

BRIEF DESCRIPTION OF THE DRAWINGS

The features and advantages of the present subject matter will be more readily understood from the following detailed description which should be read in conjunction with the accompanying drawings that are given merely by way of explanatory and non-limiting example, and in which.

DETAILED DESCRIPTION

Figure 1:
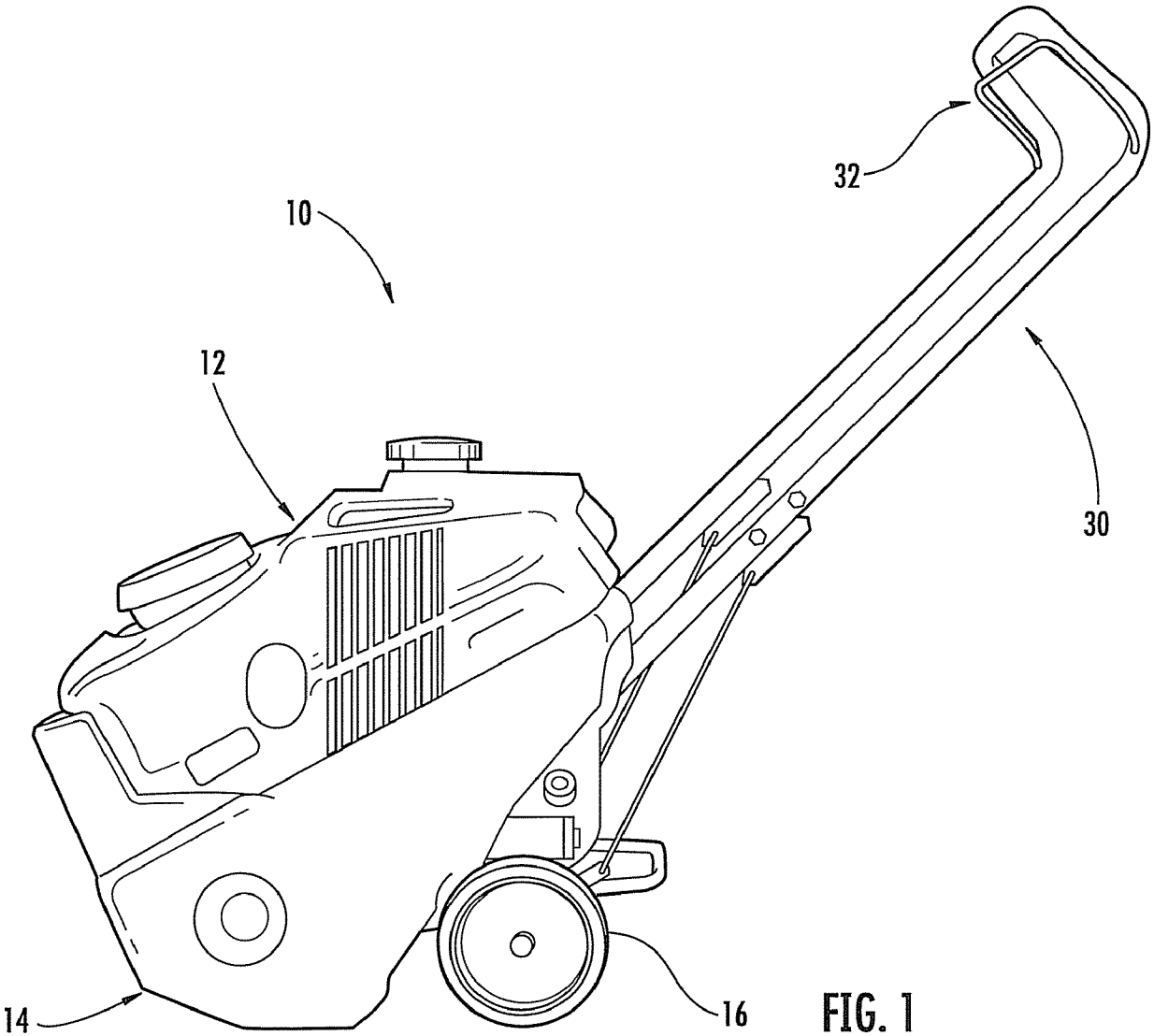
FIG. 1 is a side view of a snowblower according to an embodiment of the presently disclosed subject matter.

The present subject matter provides systems and methods for operating a snowblower. As is illustrated in FIG. 1, the present subject matter provides a snowblower, generally designated 10, including a snowblower housing generally designated 12, an auger generally designated 14 connected to housing 12 (contained within a forward section of housing 12 in FIG. 1), and at least one of wheels 16 attached to housing 12. Typically, snowblower 10 will have two opposing wheels 16 attached to a rear portion of housing 12, one on either side of housing 12, as shown for example in FIGS. 3 and 4A-4C.

Figure 2A:
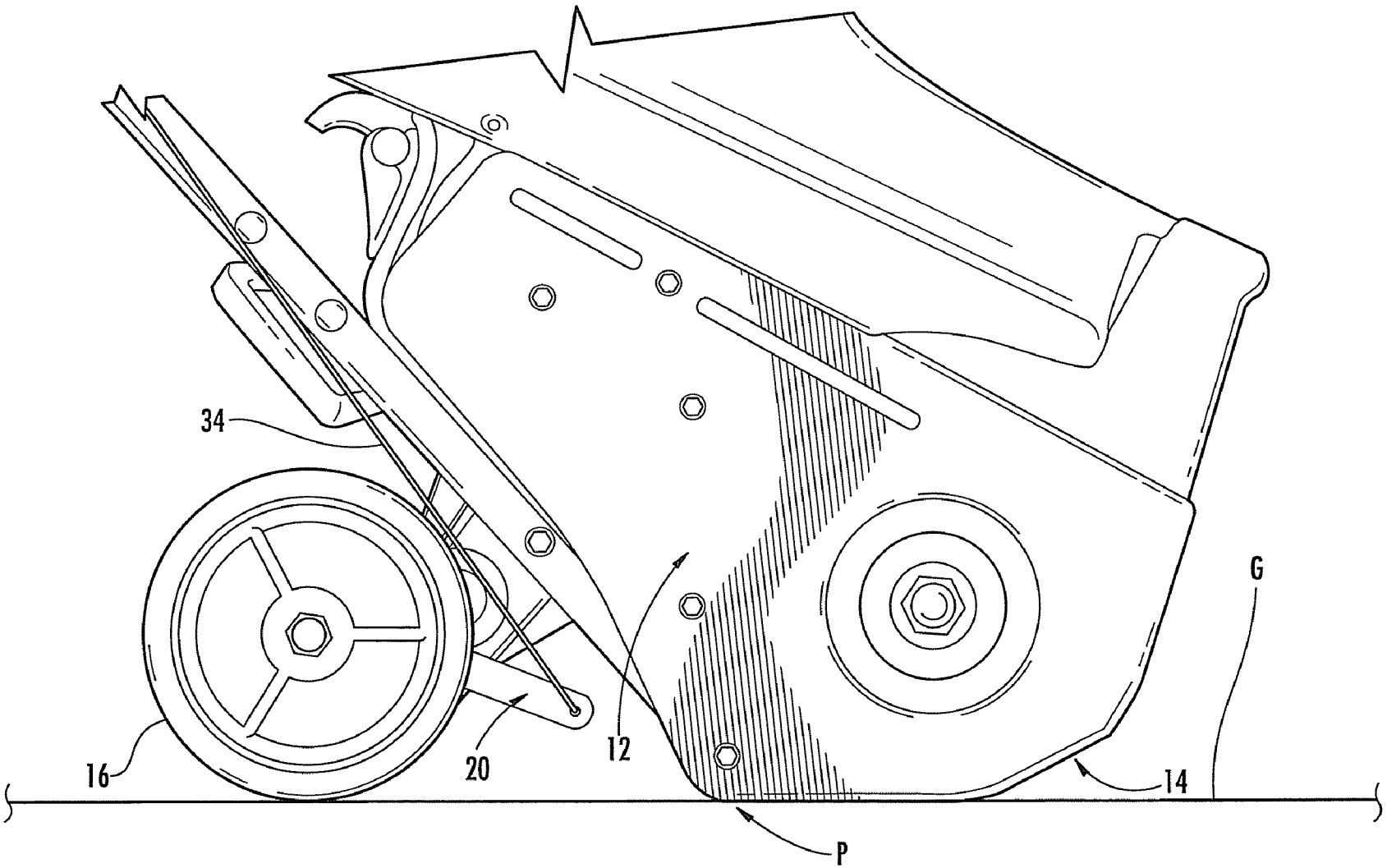
FIG. 2A is a side view of a snowblower according to an embodiment of the presently disclosed subject matter with wheels in a first position.
Figure 2B:
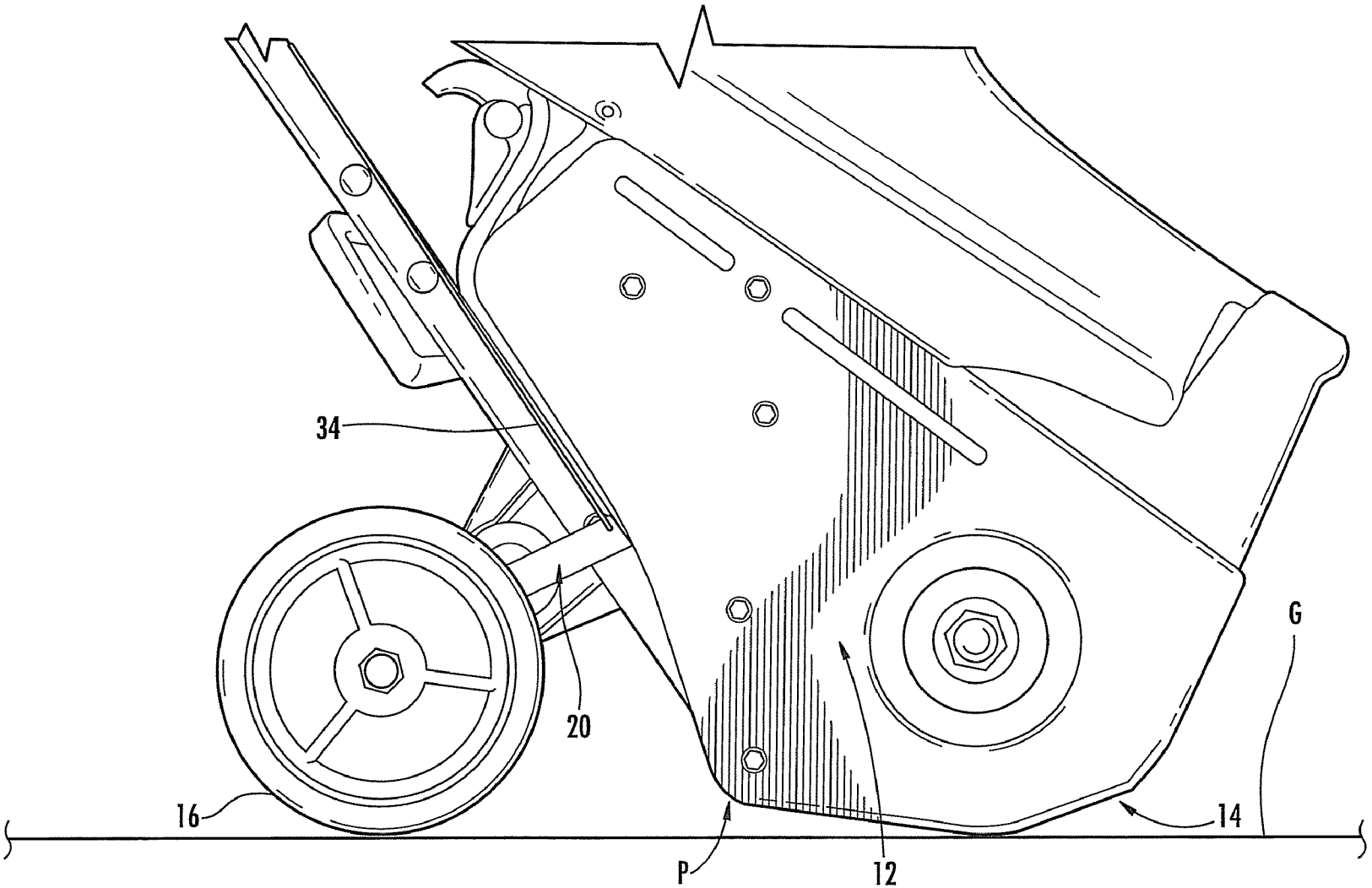
FIG. 2B is a side view of a snowblower according to an embodiment of the presently disclosed subject matter with wheels in a second position.

Referring to FIGS. 2A and 2B, wheels 16 can be movable relative to housing 12 between a first position (see, e.g., FIG. 2A) and a second position (see, e.g., FIG. 2B) to raise at least a portion of housing 12. When wheels 16 are in the first position such as in FIG. 2A, wheels 16 are in a proximate position that is relatively close to housing 12. In this position, housing 12 can be supported on a ground surface G by wheels 16 and a portion generally designated P of housing 12, and auger 14 can be raised above ground surface G. In this first position, auger 14 can draw a top layer of snow towards housing 12 for discharge away from the path to be cleaned.

Conversely, when wheels 16 are in the second position such as in FIG. 2B, wheels 16 are in an extended position further away from housing 12. A rear portion of housing 12 can thereby be positioned such that auger 14 is operatively engaged with ground surface G. In particular, snowblower 10 can be configured such that when wheels 16 are in the second position, a rear portion of housing 12 can be lifted such that housing 12 is rotated relative to ground surface G and more weight is shifted to a front portion of housing 12 having auger 14 contained therein. As a result, in this second position, auger 14 can be in operative engagement with ground surface G rather than portion P of housing 12. Accordingly, in this second position, auger 14 can draw snow towards housing 12 for discharge as well and can also engage ground surface G for pulling snowblower 10 forward.

Figure 3:
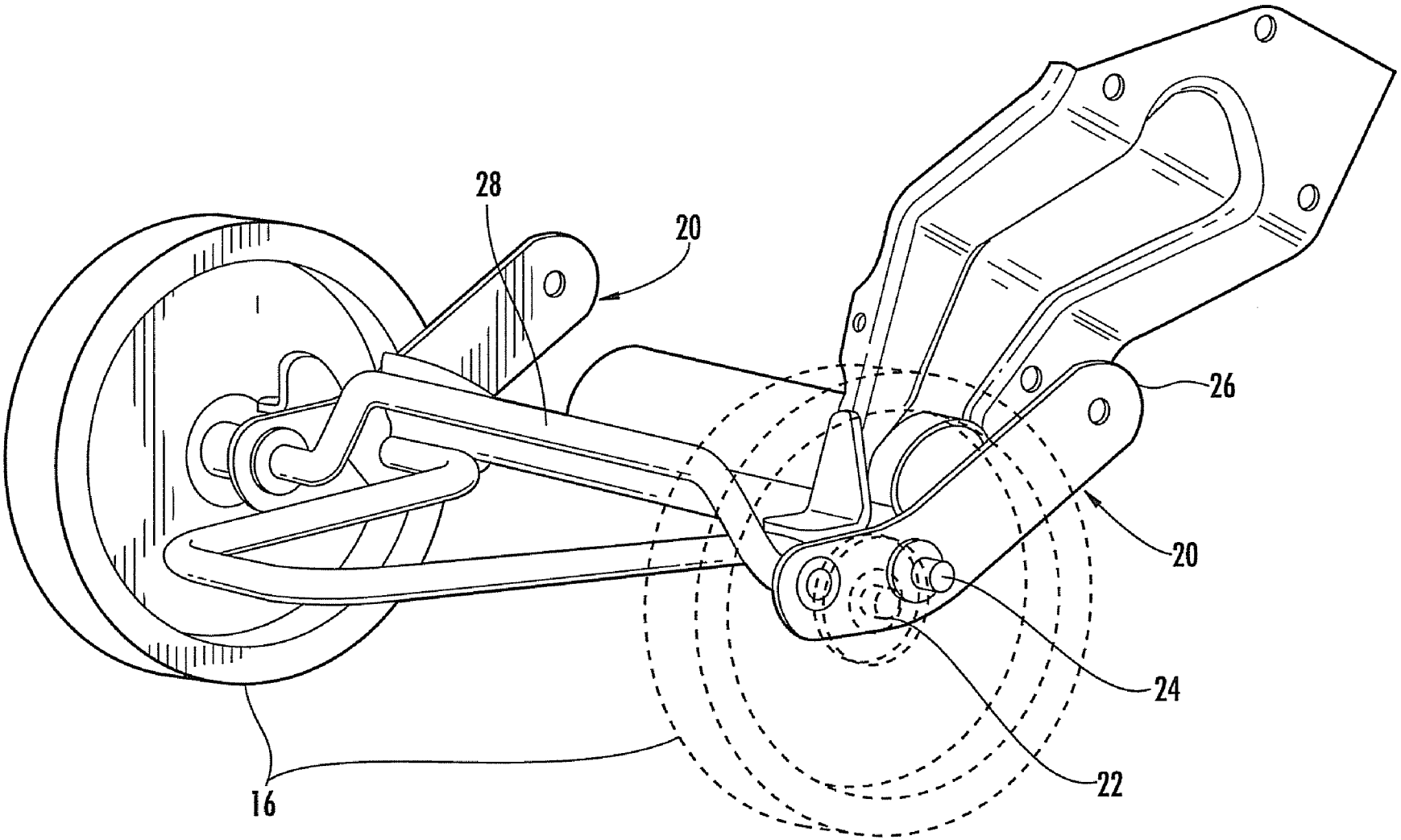
FIG. 3 is a perspective view of a movable wheel assembly for use with a snowblower shown in FIGS. 2A and 2B.

As described further herein, snowblower 10 can further include one or more lever arms 20 attaching at least one of wheels 16 to housing 12. Each of lever arms 20 can be pivotably attached to housing 12, and wheels 16 can be rotatably attached to a portion of respective lever arms 20. In this arrangement, and as shown in FIG. 3, each of lever arms 20 can be pivotably movable with respect to housing 12 for movement of associated wheels 16 between the first position and the second position. In particular, each of lever arms 20 can include a first end 22 onto which wheels 16 are rotatably attached, a pivot center 24 pivotably attached to housing 12, and a second end 26 opposite first end 22. In this form, second end 26 can be moved to cause the rotation of lever arms 20 about pivot center 24, which in turn causes first end 22 (along with wheels 16) to move relative to housing 12.

In some particular embodiments, where snowblower 10 includes two wheels 16 (i.e., one on each side of housing 12), wheels 16 can be connected by a common axle, such as a connecting rod 28, such that each of wheels 16 can be maintained at an similar position relative to housing 16. As a result, the movement of one of wheels 16 can cause the simultaneous movement of other wheels 16. The operator of snowblower 10 need only cause the movement of a single one of lever arms 20 to move all of wheels 16. Likewise, for systems with more than two wheels, any of a variety of mechanical linkages can be provided to connect the movement of all of the wheels. Accordingly, the position of all of wheels 16 relative to housing 12 can be set by an operator using a single control device.

In this regard, referring again to FIG. 1, snowblower 10 can further include a handle assembly generally designated 30 connected to and extending away from housing 12. Snowblower 10 can also include a machine control component, generally designated 32, which can be movable to selectively control the movement of wheels 16 relative to housing 12. Machine control component 32 is advantageously movable between at least a disengaged position (see, e.g., FIG. 2A), in which wheels 16 are positioned in the first position, and an engaged position (see, e.g., FIG. 2B), in which wheels 16 are positioned in the second position.

For the convenience of an operator of snowblower 10, machine control component 32 can be attached to handle assembly 30. For instance, machine control component can comprise a bail that is pivotably attached to handle assembly 30. The operator can pull the bail against handle assembly 30 to put the bail in the engaged position. Conversely, a biasing element (e.g., a spring) can be connected to machine control component 32 such that when the operator stops applying pressure to machine control component 32 (e.g., releases the bail), machine control component 32 is moved back to a disengaged position, wherein auger 14 is raised above ground surface G. Further, machine control component 32 can also be connected to a power source for snowblower 10 such that movement of machine control component 32 to a disengaged position can cause all motion of snowblower 10 to stop.

Machine control component 32 is usable to control the position of wheels 16 relative to housing 12, and such control can be through the use of an actuation cable 34 as shown for example in FIGS. 2A and 2B. Actuation cable 34 can extend between machine control component 32 and wheels 16 to control the movement of wheels 16. Specifically, as noted above, wheels 16 can be attached to housing 12 by respective lever arms 20. In this configuration, actuation cable 34 can be attached to second end 26 of one of lever arms 20 such that movement of machine control component 32 between the disengaged position and the engaged position moves actuation cable 34, which in turn can cause movement of lever arms 20 with respect to housing 12. Alternatively, actuation cable 34 can be attached to each of lever arms 20 such that movement of machine control component 32 between the disengaged position and the engaged position moves actuation cable 34, which in turn can cause movement of each of lever arms 20 connected to actuation cable 34.

Figure 4A:
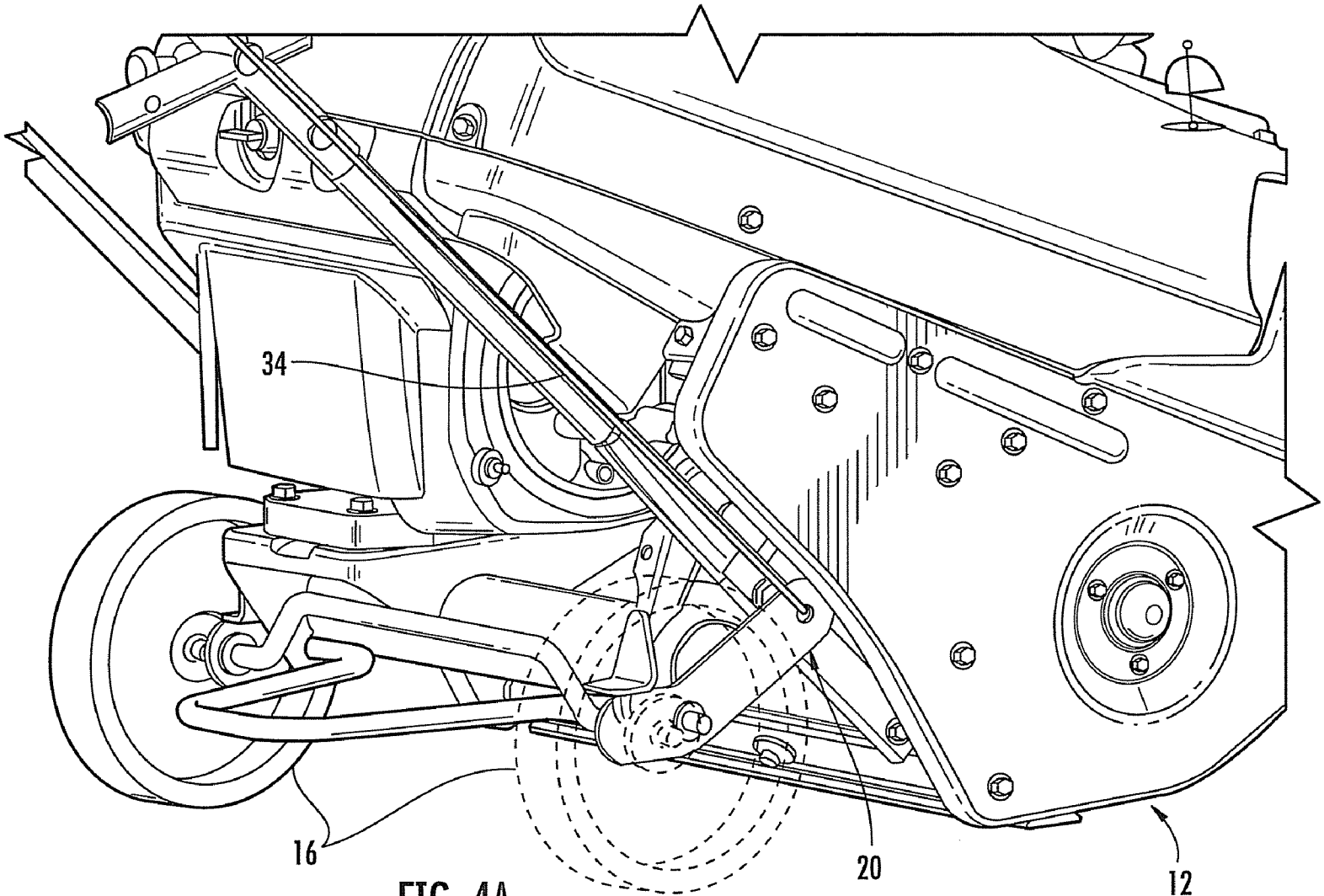
FIGS. 4A through 4C are rear perspective views of a snowblower according to an embodiment of the presently disclosed subject matter with wheels in different positions.
Figure 4B:
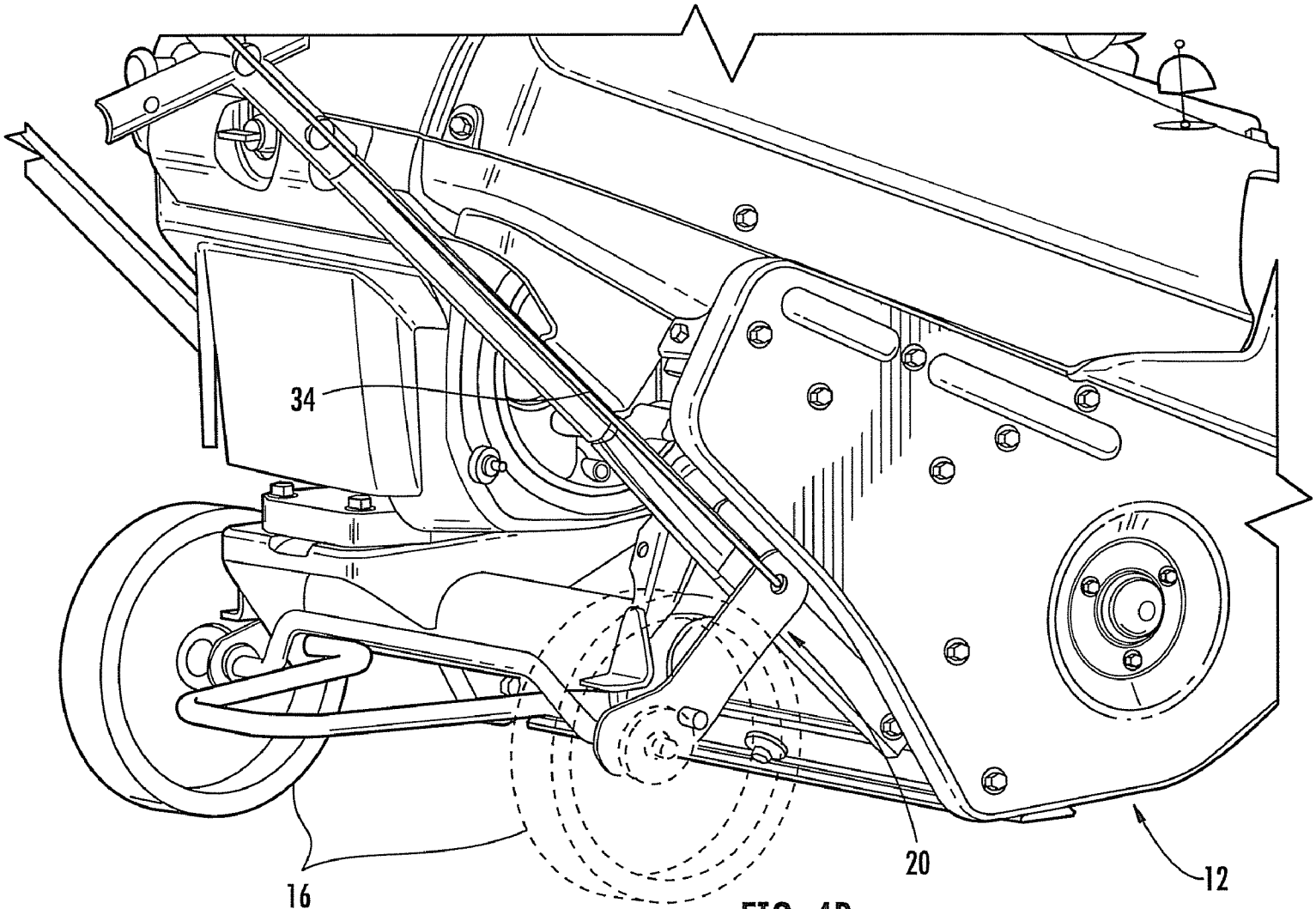
Figure 4C:
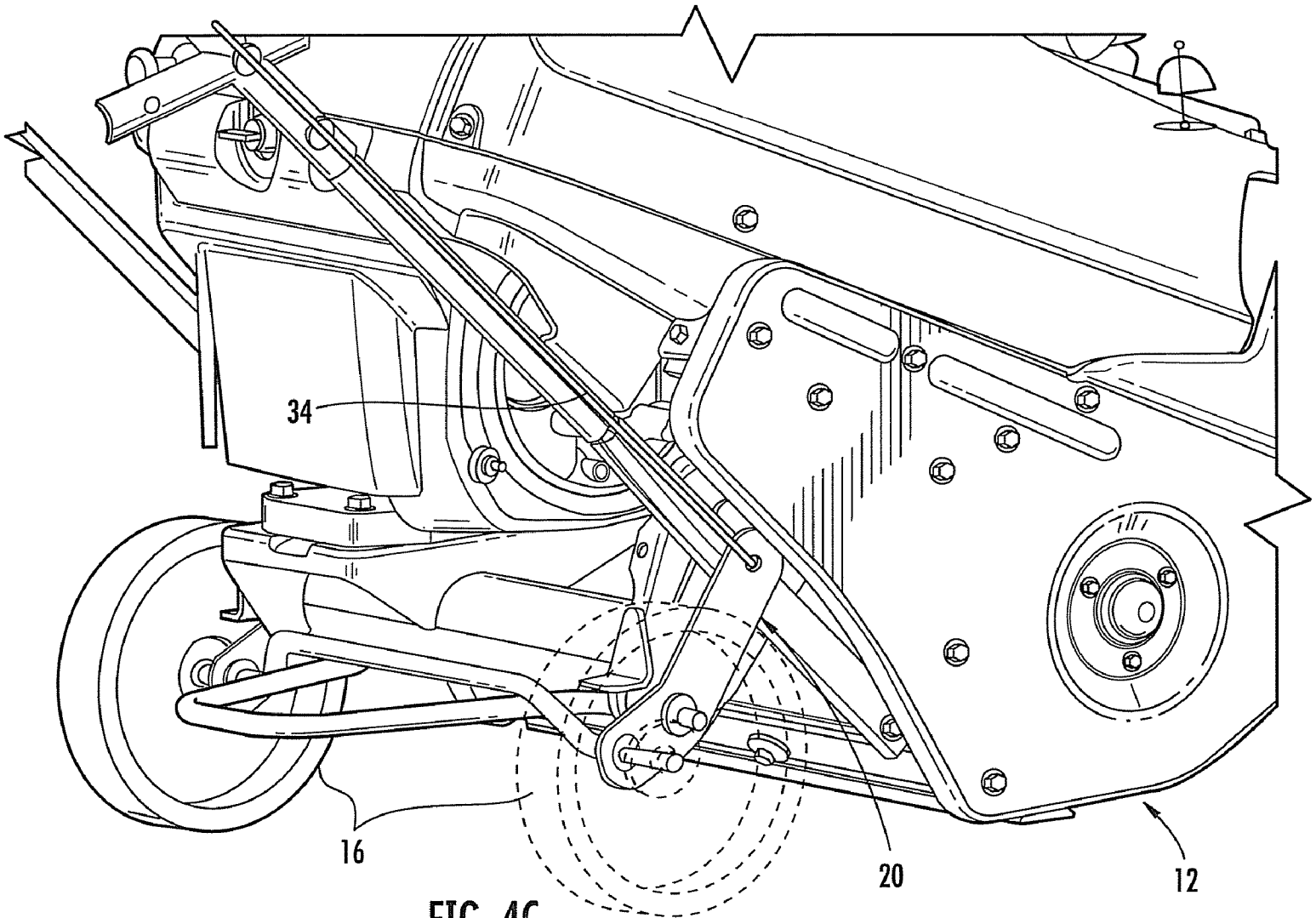

With snowblower 10 having a configuration such as described above and shown in the various figures of drawings, an operator can easily control the operation of snowblower 10 between engaged and disengaged states as shown for example in FIGS. 4A through 4C. For instance, the operator can move machine control component 32 attached to handle assembly 30 between a disengaged position and an engaged position. Specifically, moving machine control component 32 moves wheels 16 relative to housing 12 such that when machine control component 32 is in a disengaged position, wheels 16 are in a first position illustrated in FIG. 4A, causing housing 12 to be positioned such that auger 14 is raised above ground surface G. When machine control component 32 is actuated, the motion of machine control component 32 causes lever arms 20 to rotate (e.g., about pivot center 24) such that wheels 16 are moved toward a second position from the first position as is illustrated in FIG. 4B. When machine control component 32 is in a fully engaged position, wheels 16 are in the second position illustrated in FIG. 4C, causing housing 12 to be positioned such that auger 14 is operatively engaged with ground surface G.

Further, as noted above, moving machine control component 32 can involve moving actuation cable 34 (e.g., by moving a pivotable bail) connecting machine control component 32 to wheels 16. In this manner, moving actuation cable 34 causes movement of wheels 16 with respect to housing 12 between the first position and the second position. This movement can be accomplished by pulling pivoting lever arms 20 connecting wheels 16 to housing 12 to pivot wheels 16 relative to housing 12. Because wheels 16 will always stay on the ground, this configuration allows snowblower 10 to be more stable.

As discussed above, this movement of wheels 16 between first and second positions can serve to raise the rear of housing 12 relative to wheels 16, thereby rotating housing 12 forward. In this arrangement, auger 14 can make contact with ground surface G both to engage the layer of snow lying thereon and to drive snowblower 10 forward.

The present subject matter can be embodied in other forms without departure from the spirit and essential characteristics thereof. The embodiments described therefore are to be considered in all respects as illustrative and not restrictive. Although the present subject matter has been described in terms of certain preferred embodiments, other embodiments that are apparent to those of ordinary skill in the art are also within the scope of the present subject matter.

What is claimed is:

1. A snowblower, comprising:

a snowblower housing;

an auger connected to the housing;

at least two wheels attached to the housing, the wheels being coupled to each other for movement together relative to the housing between a first position and a second position to raise at least a portion of the housing, the wheels in the first position being in a proximate position to the housing, and the wheels in the second position being in an extended position further away from the housing; and a machine control component connected to the wheels and movable to selectively control movement of the wheels relative to the housing, the machine control component being movable between a disengaged position, in which each of the wheels is positioned in the first position, and an engaged position, in which each of the wheels is positioned in the second position.

2. The snowblower of claim 1, wherein operation of the machine control component to move the wheels from the first position to the second position while the snowblower is supported on a ground surface rotates the housing to shift more weight to a front portion of the housing having the auger.

3. The snowblower of claim 2, wherein the auger is configured to pull the snowblower forward relative to the ground surface when the wheel is in the second position and the auger is operatively engaged with the ground surface.

4. The snowblower of claim 1, comprising two opposing wheels attached to a rear portion of the housing.

5. The snowblower of claim 4, comprising a connecting rod connecting the two wheels together.

6. The snowblower of claim 1, wherein the machine control component comprises a bail that is pivotably attached to the handle assembly.

7. The snowblower of claim 1, comprising a handle assembly connected to the housing, the machine control component being attached to the handle assembly.

8. The snowblower of claim 1, comprising a lever arm attaching each of the at least two wheels to the housing, each lever arm being pivotably attached to the housing and a respective one of the at least two wheels being rotatably attached to a portion of the lever arm; and wherein each lever arm is pivotably movable with respect to the housing for movement of the at least two wheels together between the first position and the second position.

9. The snowblower of claim 8, further comprising an actuation cable connecting the machine control component to at least one of the lever arms, wherein movement of the machine control component between the disengaged position and the engaged position moves the actuation cable to cause movement of the lever arms with respect to the housing.

10. The snowblower of claim 9, wherein each of the lever arms comprises a first end onto which a respective one of the at least two wheels is rotatably attached, a pivot center pivotably attached to the housing, and a second end connected to the actuation cable.

11. A snowblower, comprising a snowblower housing;

an auger connected to the housing;

a handle assembly connected to the housing, the handle assembly including a machine control component;

at least one lever arm pivotably attached to the housing and connected to the machine control component;

at least two wheels attached to a rear portion of the housing and supporting the housing, at least one of the wheels being connected to the lever arm, the wheels being coupled to each other for movement together with the lever arm relative to the housing between a first position and a second position, where in the first position the wheels are close to the housing, and in the second position the wheels are extended away from the housing; and wherein the machine control component is movable to selectively control movement of the wheels relative to the housing, the machine control component being movable between a disengaged position, in which each of the wheels is positioned in the first position, and an engaged position, in which each of the wheels is positioned in the second position.

12. The snowblower of claim 11, comprising an actuation cable connecting the machine control component to the lever arm, wherein movement of the machine control component between the disengaged position and the engaged position moves the actuation cable to cause movement of the lever arm with respect to the housing.

13. The snowblower of claim 11, comprising a connecting rod connecting the at least two wheels together.

14. The snowblower of claim 11, comprising at least two lever arms, each of the lever arms attaching one of the at least two wheels to the housing.

15. A method for positioning a snowblower on a ground surface, comprising:

providing a snowblower having a snowblower housing, with an auger, at least two wheels, and a handle assembly connected to the housing;

moving a machine control component between a disengaged position and an engaged position; and wherein moving the machine control component moves the at least two wheels together relative to the housing such that when the machine control component is in a disengaged position, each of the wheels is in a first position proximate to the housing, and when the machine control component is in an engaged position, each of the wheels is in a second position further away from the housing.

16. The method of claim 15, wherein moving the machine control component comprises moving an actuation cable connecting the machine control component to the wheels, and wherein moving the actuation cable causes movement of the wheels with respect to the housing between the first position and the second position.

17. The method of claim 16, wherein moving an actuation cable connecting the machine control component to the wheels comprises moving the actuation cable to pivot a lever arm to which at least one of the wheels is connected, wherein pivoting the lever arm causes movement of the wheels with respect to the housing between the first position and the second position.

18. The method of claim 15, wherein moving a machine control component comprises moving a bail that is pivotably attached to the handle assembly.

19. The method of claim 15, wherein causing the auger to be operatively engaged with the ground surface comprises rotating the housing relative to the ground surface to position the auger in contact with the ground surface.

* * * * *